US006131203A

United States Patent [19]

Cominsky

[11] Patent Number: 6,131,203

[45] Date of Patent: Oct. 17, 2000

[54] TRANSPORT HOOD INCLUDING CINCHING GROMMET

[76] Inventor: John C. Cominsky, 259 N. Hwy. 161, Clover, S.C. 29710

[21] Appl. No.: 09/525,587

[22] Filed: Mar. 15, 2000

Related U.S. Application Data

[60] Provisional application No. 60/146,171, Jul. 30, 1999.

[51] Int. Cl.[7] ..... A41D 13/00; A42B 1/04

[52] U.S. Cl. ..... 2/202; 2/206; 2/9

[58] Field of Search ..... 2/202, 206, 205, 2/204, 9, 174, 171, 203, 173, 4, 417, 424, 457, 410, 183; 128/857, 201.25, 873, 869

[56] References Cited

U.S. PATENT DOCUMENTS

| | | | |
|---|---|---|---|
| 1,186,703 | 6/1916 | Sullivan | 2/202 |
| 2,477,437 | 7/1949 | Borowick | 2/174 |
| 2,869,132 | 1/1959 | Drummond | 2/174 |
| 3,084,446 | 4/1963 | Freedman et al. | 2/204 |
| 3,241,155 | 3/1966 | Phillips | 2/9 |
| 4,173,042 | 11/1979 | Krzewinski-Morris | 2/174 |
| 4,698,853 | 10/1987 | Walton | 2/174 |
| 4,805,639 | 2/1989 | Dial et al. | 128/857 |
| 4,887,316 | 12/1989 | Morandini | 2/174 |
| 5,367,706 | 11/1994 | Davidson | 2/202 |
| 5,664,262 | 9/1997 | Cominsky . | |
| 5,708,982 | 1/1998 | Armani | 2/204 |
| 5,842,231 | 12/1998 | Dawes | 2/202 |
| 5,864,887 | 2/1999 | Kozawa | 2/202 |

*Primary Examiner*—Amy B. Vanatta
*Attorney, Agent, or Firm*—Christopher C. Dremann, PC; Christopher C. Dremann

[57] ABSTRACT

A transport hood for protecting personnel from exposure to the bodily fluids of a detainee includes a top portion, a bottom portion joined to the top portion and a cinching grommet. The top portion is made of a transparent, fine mesh material and has a continuous lowermost edge. The bottom portion is made of a breathable, fluid impervious material and has a continuous uppermost edge and a continuous lowermost edge. Preferably, a first length of elastic is sewn to the lowermost edge of the top portion and to the uppermost edge of the bottom portion to gather the bottom portion of the transport hood below the eyes of the detainee. A second length of elastic is preferably sewn to the lowermost edge of the bottom portion to gather the bottom portion just below the chin of the detainee. Preferably, the cinching grommet is a thin disk having an opening formed therethrough for grasping and securing a variable amount of the excess material of the top portion of the transport hood. The excess material is pulled through the opening of the cinching grommet until the transport hood is properly positioned on the head of the detainee with the lowermost edge of the top portion and the uppermost edge of the bottom portion just below the eyes of the detainee. In other preferred embodiments, the cinching grommet is an elongate, hollow cylinder, a short length of string or wire, a split washer or a continuous elastic band.

12 Claims, 2 Drawing Sheets

TRANSPORT HOOD INCLUDING CINCHING GROMMET

CROSS-REFERENCE TO RELATED APPLICATION

This application claims the priority of U.S. Provisional Patent Application Ser. No. 60/146,171 filed Jul. 30, 1999.

FIELD OF THE INVENTION

This invention relates generally to a transport hood for protecting personnel from the bodily fluids of individuals who are being confined, restrained or taken into custody against their will, and particularly, while such individuals are being transported from one location to another. Specifically, the invention relates to a transport hood including a cinching grommet for gathering and securing the excess material of the top portion of the transport hood and thereby properly position the transport hood on the head of the detainee.

BACKGROUND OF THE INVENTION

In many institutional settings, such as prisons, jails, hospitals and mental health facilities, individuals are confined, restrained or taken into custody against their will. It is also necessary from time to time for personnel, such as law enforcement officers, to transport individuals in such settings from one location to another. Transporting detainees causes stress on both the detainee and the personnel having the responsibility to transport the detainee. Detainees may threaten or attempt to bite or spit on the personnel. In addition, the detainee may be infected with any of a number of communicable diseases that are transmitted through bodily fluids, such as the blood, saliva or mucus expelled by the detainee.

In order to protect such personnel, protective head coverings have been developed to prevent biting, spitting and the spread of communicable diseases. The inventor of the present invention is patentee of a prior U.S. patent covering a transport hood for protecting personnel from detainees and their bodily fluids. U.S. Pat. No. 5,664,262 discloses a transport hood that includes a top portion and a bottom portion made of different materials. The top portion is made of a substantially transparent material. The bottom portion is made of a material that is impervious to bodily fluids that can be expelled by the detainee. The top and bottom portions are joined by a first length of elastic that gathers the transport hood at a point just below the eyes of the detainee. A second length of elastic may be provided along the bottom edge of the bottom portion to secure the bottom of the transport hood around the wearer's neck just below the chin of the detainee. Both lengths of elastic are intended to secure the transport hood snugly on the head of the wearer without seriously restricting the breathing or impairing the comfort of the detainee.

One advantage of the prior transport hood is that it may be easily placed over and positioned on a detainee's head even if the detainee is struggling to resist restraint. Because the entire top portion of the transport hood is made of substantially transparent material, there is no need to align any particular part of the top portion of the transport hood with the detainee's eyes. The top portion is constructed using excess material to facilitate placing the transport hood over the detainee's head. The excess material also insures that the transport hood is large enough to fit individuals of all sizes. However, the excess material in the top portion of the transport hood creates two problems. First, the wearer can pull the transport hood down far enough that the top portion, which is not impervious to bodily fluids, exposes the nose or mouth of the detainee. Thus, personnel could come into contact with the detainee's body fluids. Second, the excess material of the top portion of the transport hood can gather around the eyes of the wearer and obscure the detainee's vision.

Thus, it is apparent that there is a need for a means for preventing a transport hood from being improperly positioned on the head of a detainee so as to expose personnel to the detainee's body fluids.

Further, it is apparent that there is a need for a means for preventing the excess material of the top portion of the transport hood from obscuring the detainee's vision.

SUMMARY OF THE OBJECTS OF THE INVENTION

It is a primary object of this invention to provide a means for preventing a transport hood from being improperly positioned on the head of a detainee and thereby expose personnel to the detainee's body fluids.

It is a further object of this invention to provide a means for gathering and securing the excess material of the top portion of the transport hood so that the excess material does not gather around the wearer's eyes and obscure the detainee's vision.

SUMMARY OF THE INVENTION

A transport hood for protecting personnel from bodily fluids, such as blood, saliva and mucus, that can be expelled by a detainee includes a top portion and a bottom portion. The top portion is made of a fine mesh material that is substantially transparent so that the top portion does not seriously restrict the vision or breathing of the detainee and permits the personnel to observe the eyes of the detainee. The bottom portion is made of a breathable cloth that is impervious to the bodily fluids that can be expelled by the detainee. The bottom portion has a continuous lowermost edge and a continuous uppermost edge. The uppermost edge of the bottom portion is joined to the top portion along a continuous lowermost edge of the top portion. The transport hood includes a cinching grommet for gathering and securing the excess material of the top portion so that the transport hood is properly positioned on the head of the detainee with the lowermost edge of the top portion and the uppermost edge of the bottom portion just below the eyes of the detainee.

Preferably, a first length of elastic extends along and is fixed to the lowermost edge of the top portion and to the uppermost edge of the bottom portion. The first length of elastic gathers the lowermost edge of the top portion and the uppermost edge of the bottom portion just below the eyes of the detainee. The first length of elastic is preferably stitched or sewn to the lowermost edge of the top portion and to the uppermost edge of the bottom portion. Preferably, a second length of elastic extends along and is fixed to the lowermost edge of the bottom portion for gathering the lowermost edge of the bottom portion just below the chin of the detainee. Similarly, the second length of elastic is preferably stitched or sewn to the lowermost edge of the bottom portion.

In one preferred embodiment, the cinching grommet consists of a thin disk having an opening therethrough for gathering an amount of the excess material of the top portion of the transport hood that is necessary to properly position the transport hood on the head of the detainee. The opening may be formed by a plurality of radially extending slits that intersect near the center of the disc. The slits define relatively sharp corners, referred to herein as grasping points, that grasp and secure the necessary amount of the excess material of the top portion. In another preferred embodiment, the cinching grommet consists of a cylinder having a bore therethrough. The necessary amount of the excess material of the top portion is threaded into and pulled through the bore to properly position the transport hood on the head of the detainee. In other preferred embodiments, the cinching grommet is a string or metal twist-tie, a split washer or a continuous band of elastic material, such as rubber band.

BRIEF DESCRIPTION OF THE DRAWINGS

In view of the aforementioned objects and others, which will more readily appear as the nature of the invention is better understood, the invention consists in the novel combination and arrangement of parts hereinafter more fully described, illustrated and claimed with reference being made to the accompanying drawings in which:

DETAILED DESCRIPTION OF THE PREFERRED EMBODIMENTS

Figure 3:
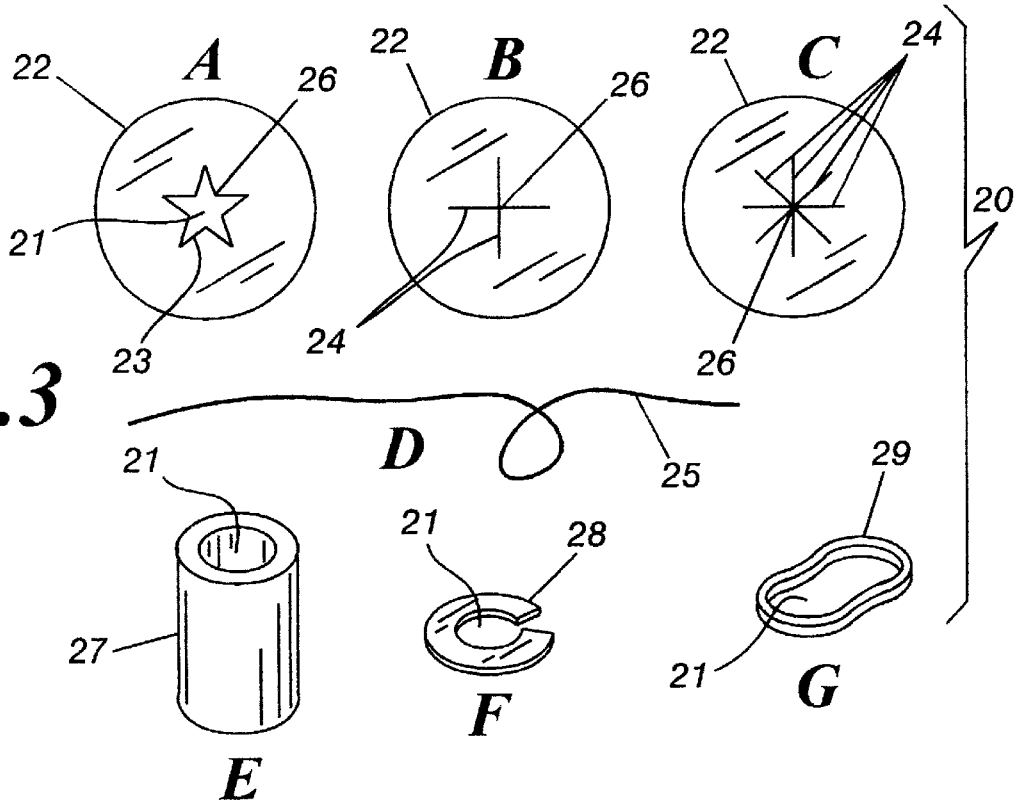
FIG. 3 illustrates a number of alternative preferred embodiments of the cinching grommet of the invention.

A number of alternative preferred embodiments of the present invention will be described more fully hereinafter. However, the invention should not be construed as being limited to the embodiments described herein. Rather, it is intended that the invention be construed broadly to encompass any and all embodiments of a transport hood including a cinching grommet having the features disclosed herein, or equivalents thereof, which is within the skill of an ordinary person in the relevant art. In the description, like reference numerals designate like or corresponding parts throughout the several figures. It is to be also understood that such terms as "top," "bottom," "uppermost" and "lowermost" are used in the description for purposes of locating one element relative to another and are not to be construed as limiting terms. Finally, it should be understood that the illustrations provided in the accompanying figures are for the purpose of describing the various embodiments of the invention, and thus, are not intended to limit the scope of the invention in any manner.

Figure 1:
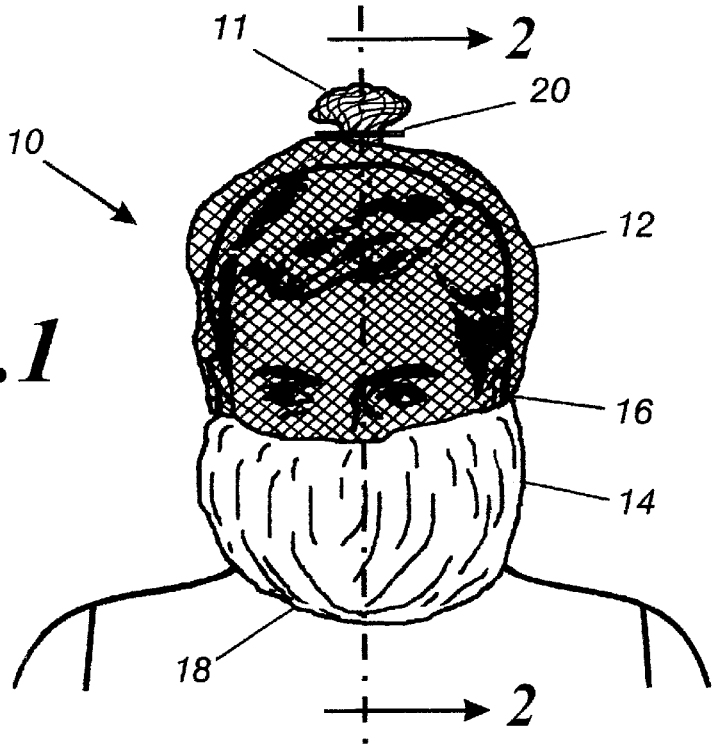
FIG. 1 is a perspective view of a transport hood including a cinching grommet according to the present invention illustrating the proper position of the transport hood on the head of the wearer.

Referring now more specifically to the drawings, FIG. 1 is a perspective view of a protective head covering, or transport hood, 10 according to the present invention. FIG. 1 illustrates the proper position of the transport hood 10 on the head of the detainee. The transport hood 10 is generally dome-shaped, and thus symmetric about its longitudinal axis. As shown, the transport hood 10 comprises a top portion 12, a bottom portion 14, a first length of elastic material 16 and a second length of elastic material 18. The transport hood 10 is placed over the head of a detainee, such as a prisoner, to protect personnel, such as law enforcement officers, guards and medical and health care practitioners from contact with the detainee's blood and other body fluids.

As illustrated in FIG. 1, the transport hood 10 covers the entire head of the detainee. The top portion 12 of the transport hood 10 covers the head of the detainee upwardly from a point just below the eyes of the detainee. The top portion 12 is made of a substantially transparent material, such as a fine mesh of fabric. The size of the openings in the mesh should be large enough to provide the detainee with relatively unrestricted vision and to not seriously restrict the breathing or impair the comfort of the detainee. The bottom portion 14 of the transport hood 10 covers the head of the detainee downwardly from a point just below the eyes of the detainee. The bottom portion 14 is made of a breathable plastic or fabric cloth that is impervious to bodily fluids that can be expelled by the detainee. Preferably, the cloth is a polypropylene cloth of the type commonly used in medical and surgical apparel or surgical drapery that provides an effective barrier against pathogens borne by blood, saliva and mucus as well as airborne pathogens that can be expelled when the detainee coughs or sneezes. However, the cloth is breathable so that it does not seriously restrict the breathing or impair the comfort of the detainee.

Figure 2:
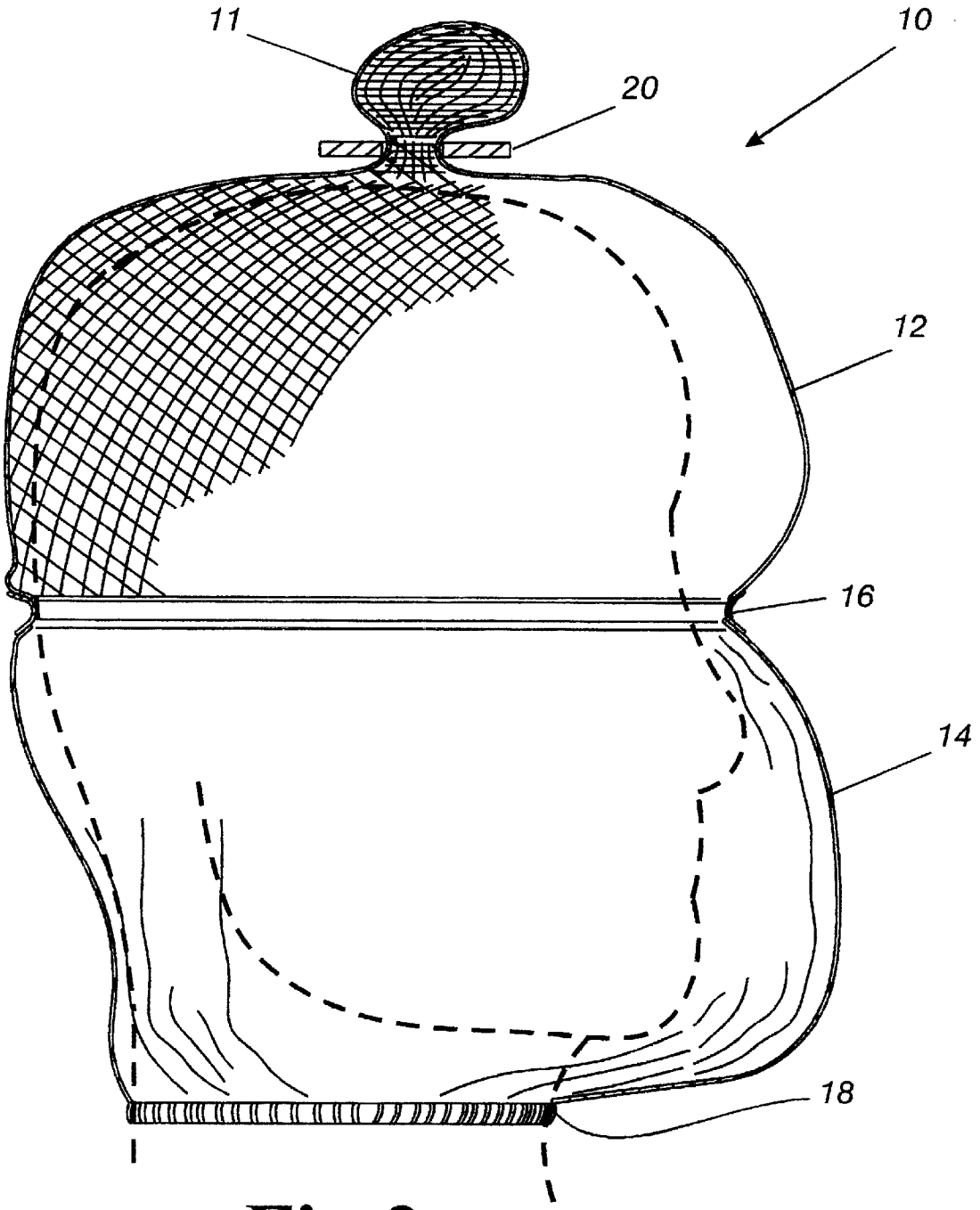
FIG. 2 is a sectional view of the transport hood of FIG. 1 taken along line 2—2 in FIG. 1.

As best shown in FIG. 2, the lowermost edge of the top portion 12 is joined to the uppermost edge of the bottom portion 14 of the transport hood 10. A first length of elastic 16 is preferably sewn into the top portion 12 and into the bottom portion 14 to form an elastic seam so that the top 12 and bottom 14 portions of the transport hood 10 cannot be readily separated under conditions of normal use. The first length of elastic 16 gathers the top portion 12 and the bottom portion 14 of the transport hood 10 at a location just below the eyes of the detainee to hold the transport hood 10 in proper position on the head of the wearer, without causing pain or seriously restricting the breathing or impairing the comfort of the detainee. Similarly, a second length of elastic 18 is preferably sewn into the lowermost edge of the bottom portion 14 of the transport hood 10. The second length of elastic 18 has sufficient elasticity to permit the transport hood 10 to be stretched easily over the head of the detainee, while holding the transport hood 10 in proper position around the neck of the wearer without seriously restricting the breathing or impairing the comfort of the detainee.

As best shown in FIG. 1, the top portion 12 is gathered and secured immediately above the head of the wearer to further properly position the transport hood 10 on the head of the detainee. The top portion 12 is constructed using excess material to facilitate placing the hood over the wearer's head and to insure that the transport hood 10 can be used on detainees of all ages and size. As a result, the transport hood 10 comprises a cinching grommet 20 to gather and secure a variable amount of the excess material 11 of the top portion 12 immediately above the head of the detainee. Any number of devices may be used to gather and secure the excess material 11 of the top portion 12 of the transport hood 10. Preferably, the cinching grommet 20 is inexpensive, disposable, and requires a minimal amount of coordination, effort and time to gather and secure the excess material 11. Furthermore, the cinching grommet 20 must not tear the fragile mesh material of the top portion 12 of the transport hood 10.

A number of alternative preferred embodiments of a cinching grommet 20 are shown in FIG. 3. In a preferred embodiment, the cinching grommet 20 may be a thin disk 22 having an opening 21 formed therethrough. The disk 22 is preferably made of plastic or other durable, tough, lightweight and flexible material. As illustrated by example A of FIG. 3, the opening 21 may be formed in the shape of a five-pointed star 23 positioned in the center of the disk 22. The points of the star 23 define a plurality, and specifically five, flexible grasping points 26 for grasping and securing the excess material 11 of the top portion 12 of the transport hood 10. The opening 21 may be formed in any shape as long as the opening 21 defines a sufficient number of grasping points 26 to adequately grasp and secure the excess material 11 of the top portion 12 of the transport hood.

Alternatively, as illustrated by example B in FIG. 3, the opening 21 may be formed by a pair of perpendicular, radially extending slits 24 intersecting near the center of the disk 22. The intersection of the slits 24 defines a plurality, and specifically four, flexible grasping points 26 for grasping and securing the excess material 11 of the top portion 12 of the transport hood 10. As illustrated by example C in FIG.

3, the opening 21 may be formed by any number of slits 24 intersecting near the center of the disk 22 to define a plurality, and specifically twice the number of slits, of flexible grasping points 26 for grasping and securing the excess material 11 of the top portion 12 of the transport hood 10. However, increasing the number of slits 24 decreases the overall strength of the disk 22.

In operation, the transport hood 10 is placed over the detainee's head with a small amount of the excess material 11 of the top portion 12 pulled through the opening 21 of the cinching grommet 20. The excess material 11 is pulled further through the opening 21 of the cinching grommet 20 until enough of the excess material 11 has passed through the opening 21 of the disk 22 to properly position the transport hood 10 on the head of the detainee. The grasping points 26 defined by the opening 21 or the slits 24 grasp and secure the excess material 11 of the top portion 12 of the transport hood 10, thereby preventing the excess material 11 from being readily removed from the cinching grommet 20. Accordingly, the transport hood 10 remains in the proper position on the head of the detainee with the lowermost edge of the top portion 12 and the uppermost edge of the bottom portion 14 just below the eyes of the detainee.

Examples D, E, F and G of FIG. 3 illustrate other alternative preferred embodiments of the cinching grommet 20. Example D illustrates a relatively short length of string or wire, such as a conventional twist-tie 25. The twist-tie 25 is tied or twisted around the excess material 11 of the top portion 12 once the transport hood 10 is properly positioned on the head of the detainee and the excess material 11 has been gathered together. Example E illustrates an elongate, preferably cylindrical, hollow barrel 27 made of plastic, metal or any similar material having sufficient strength that the excess material 11 of the top portion 12 of the transport hood 10 can be pulled through the opening 21 of the barrel 27. Example F illustrates a bendable, crimp-type closure, such as a split washer 28, made of plastic, metal or any similar material having sufficient strength that the excess material 11 of the top portion 12 of the transport hood 10 can be pulled through the opening 21 of the split washer 28. Example G illustrates a continuous elastic band, such as a rubber band 29. The rubber band 29 is placed over the excess material 11 of the top portion 12 once the transport hood 10 is properly positioned on the head of the detainee and the excess material 11 has been gathered together.

While these alternative preferred embodiments of the cinching grommet 20 have been illustrated and described, any of a number of conventional securing devices may be used with the transport hood 10 of the present invention. It is essential, however, that the cinching grommet 20 grasps and secures the excess material 11 of the top portion 12 of the transport hood 10 without tearing the fine mesh material of the top portion 12 as it is pulled through the opening 21 of the cinching grommet 20. It is also essential that the cinching grommet 20 require minimal coordination, effort and time to use in the combative and stressful situations that arise when individuals are restrained against their will. Accordingly, a tab (not shown) may be affixed to the top portion 12 of the transport hood 10 to facilitate gathering and securing the excess material 11. The tab may be formed of a small piece of fabric, a loop of string, elastic band or any other structure that may be easily grasped and pulled through the opening 21 of the cinching grommet 20.

That which is claimed is:

1. A transport hood for protecting personnel from bodily fluids expelled by a detainee, said transport hood comprising:

a top portion made of a fine mesh material which is substantially transparent such that said top portion provides the detainee with substantially unrestricted vision and breathing and permits the personnel to observe the head of the detainee from any direction, said top portion having a continuous lowermost edge;

a bottom portion made of a breathable cloth that is impervious to the bodily fluids expelled by the detainee, said bottom portion having a continuous uppermost edge and a continuous lowermost edge, the uppermost edge of said bottom portion being joined to the lowermost edge of said top portion; and a cinching grommet selectively movable on said top portion to grasp and secure a variable amount of excess material of said top portion such that the lowermost edge of said top portion and the uppermost edge of said bottom portion are positioned below the eyes of the detainee.

2. A transport hood according to claim 1 further comprising a first length of elastic that extends along and is fixed to the lowermost edge of said top portion and the uppermost edge of said bottom portion, said first length of elastic gathering the lowermost edge of said top portion and the uppermost edge of said bottom portion below the eyes of the detainee.

3. A transport hood according to claim 2 wherein said first length of elastic is sewn to the lowermost edge of said top portion and to the uppermost edge of said bottom portion.

4. A transport hood according to claim 1 further comprising a second length of elastic that extends along and is fixed to the lowermost edge of said bottom portion, said second length of elastic gathering the lowermost edge of said bottom portion below the chin of the detainee.

5. A transport hood according to claim 4 wherein said second length of elastic is sewn to the lowermost edge of said bottom portion.

6. A transport hood according to claim 1 wherein said cinching grommet comprises a thin disk having an opening formed therethrough for gathering and securing said excess material of said top portion.

7. A transport hood according to claim 6 wherein the opening through said disk is formed in the shape of a five-pointed star defining a plurality of grasping points for grasping and securing said excess material of said top portion.

8. A transport hood according to claim 6 wherein the opening through said disk is formed by a plurality of intersecting slits defining a plurality of grasping points for grasping and securing said excess material of said top portion.

9. A transport hood according to claim 1 wherein said cinching grommet comprises an elongate cylinder having a bore therethrough for receiving said excess material of said top portion therein.

10. A transport hood according to claim 1 wherein said cinching grommet comprises an elongate string for grasping and securing said excess material of said top portion.

11. A transport hood according to claim 1 wherein said cinching grommet comprises a split washer for grasping and securing said excess material of said top portion.

12. A transport hood according to claim 1 wherein said cinching grommet comprises a continuous elastic band for grasping and securing said excess material of said top portion.

* * * * *